US008727404B2

(12) United States Patent
Martin

(10) Patent No.: US 8,727,404 B2
(45) Date of Patent: May 20, 2014

(54) SYSTEM AND DEVICE FOR MAINTAINING A DOOR IN AN OPEN POSITION AND/OR PREVENTING A DOOR FROM LOCKING

(76) Inventor: Manuel A. Martin, Palatine, IL (US)

( * ) Notice: Subject to any disclaimer, the term of this patent is extended or adjusted under 35 U.S.C. 154(b) by 664 days.

(21) Appl. No.: 12/918,002

(22) PCT Filed: Mar. 17, 2009

(86) PCT No.: PCT/US2009/037394

§ 371 (c)(1),
(2), (4) Date: Aug. 17, 2010

(87) PCT Pub. No.: WO2009/117411

PCT Pub. Date: Sep. 24, 2009

(65) Prior Publication Data

US 2010/0325966 A1 Dec. 30, 2010

Related U.S. Application Data

(60) Provisional application No. 61/083,003, filed on Jul. 23, 2008, provisional application No. 61/069,789, filed on Mar. 18, 2008.

(51) Int. Cl.
*E05B 15/02* (2006.01)

(52) U.S. Cl.
USPC ..... 292/341.14; 292/1; 292/DIG. 15

(58) Field of Classification Search
USPC ..... 292/341.14, 1, DIG. 15
See application file for complete search history.

(56) References Cited

U.S. PATENT DOCUMENTS

| | | | | | |
|---|---|---|---|---|---|
| 2,659,169 | A * | 11/1953 | Brennan | 40/1.5 |
| 2,726,892 | A * | 12/1955 | Zynda et al. | 292/341.14 |
| 2,778,766 | A * | 1/1957 | Kloote et al. | 156/256 |
| 3,325,854 | A * | 6/1967 | Steigerwald | 16/375 |
| 4,453,752 | A * | 6/1984 | McKann | 292/341.19 |
| 4,878,267 | A * | 11/1989 | Roach et al. | 16/250 |
| D323,976 | S * | 2/1992 | Barnes | D8/402 |
| 5,096,241 | A * | 3/1992 | Badger | 292/288 |
| 5,291,631 | A * | 3/1994 | Schjoneman | 16/86 R |
| 5,680,675 | A * | 10/1997 | Davis | 16/83 |
| 6,082,790 | A * | 7/2000 | Mossotti et al. | 292/341.14 |
| 6,581,991 | B2 * | 6/2003 | Galindo | 292/341.16 |
| 6,612,629 | B2 * | 9/2003 | O'Hanlon | 292/346 |
| 6,698,807 | B1 * | 3/2004 | Wacker | 292/341.14 |
| 7,374,213 | B2 * | 5/2008 | Carlson | 292/343 |
| 7,469,869 | B2 * | 12/2008 | Killion | 248/309.4 |

(Continued)

FOREIGN PATENT DOCUMENTS

| | | |
|---|---|---|
| JP | 14121954 A | 4/2002 |
| KR | 20-0305070 Y1 | 2/2003 |

OTHER PUBLICATIONS

International Search Report from International Application No. PCT/US2009/037394.

(Continued)

*Primary Examiner* — Mark Williams
(74) *Attorney, Agent, or Firm* — Ungaretti & Harris LLP

(57) ABSTRACT

A device for preventing a door with an automatic locking mechanism from locking and for propping a door in an open position is provided. The device includes a bar with a first surface and an opposing second surface. One or more magnets are connected to the first surface by glue. A foam layer is also connected to the first surface.

14 Claims, 10 Drawing Sheets

(56) References Cited

U.S. PATENT DOCUMENTS

| | | | | |
|---|---|---|---|---|
| 7,904,992 | B2 * | 3/2011 | Agster et al. | 16/82 |
| 8,276,221 | B2 * | 10/2012 | Ciechanowski et al. | 4/575.1 |
| D682,082 | S * | 5/2013 | Crawford | D8/402 |
| 8,458,958 | B2 * | 6/2013 | Cress | 49/462 |

OTHER PUBLICATIONS

Written Opinion of the International Searching Authority from International Application No. PCT/US2009/037394.

* cited by examiner

SYSTEM AND DEVICE FOR MAINTAINING A DOOR IN AN OPEN POSITION AND/OR PREVENTING A DOOR FROM LOCKING

CROSS-REFERENCE TO RELATED APPLICATIONS

The present application is a 371 of International Application No. PCT/US2009/037394, with an international filing date of Mar. 17, 2009, which claims the benefit of U.S. Provisional Patent Application No. 61/083,003 filed Jul. 23, 2008, and U.S. Provisional Patent Application No.61/069,789filed Mar. 18, 2008, the contents of which are incorporated herein by reference.

FEDERALLY SPONSORED RESEARCH OR DEVELOPMENT

N/A

FIELD OF THE INVENTION

The present invention generally relates to a system or device which can be used to prop open a door or prevent a door from locking; and more particularly, to a dual use device especially useful in emergency situations that can be inserted into the hinge area of a door to prop it open, or can be magnetically connected to the door or door frame (i.e., over the strike plate) to prevent the door from automatically locking when closed.

BACKGROUND OF THE INVENTION

Certain buildings and other structures include doors that automatically lock when shut. In an emergency situation, such doors can trap individuals who do not have a means for unlocking the door, or otherwise slow down emergency personnel requiring access.

For example, doors to a stairwell in a building often lock behind anyone entering the stairwell. Some buildings are designed to automatically unlock these doors in the event of an emergency, such as a fire. However, many older buildings lack this feature.

In the event of a fire or other emergency, Firemen, Policemen or other Emergency personnel, typically use the stairwells to travel through the building to access the fire or other emergency, and to locate anyone trapped in the building. It is often necessary for the Emergency personnel to easily keep any doors from locking behind them.

One solution for preventing the door from locking, is to place tape over the lock mechanism on the door, or the strike plate in the door jamb. This requires the individual to carry such tape and to cut and place enough pieces of tape to ensure the door does not relock. This can be time consuming and may not work depending on the strength of the spring used for the bolt mechanism.

Another, solution is to prop the door open with an object to prevent it from reclosing after an individual has passed through. However, this approach requires one to locate an object large enough to keep the door from shutting (which can be problematic for heavy doors), and creates an impediment to others using the door. Additionally, someone else using the door may dislodge the object and allow the door to close and relock. Moreover, this approach is disadvantageous in those instances where it may be desirable to have the door close behind the individual (e.g., where smoke is entering through the door) but remain unlocked for later use.

Yet another solution sometimes available to Firemen, Policemen or other Emergency personnel, is the use of a master key or set of keys to unlock doors that have locked behind the Emergency personnel. However, in many situations there is an insufficient number of such keys available to the Emergency personnel, forcing two or more crews to share one master key or set of keys. Moreover, in the event fire and/or smoke enters the stairwell, or other location of the structure where the door is located, it may not be possible to easily see or otherwise locate the key or key slot. Precious seconds can be lost re-opening doors in this manner.

The present invention overcomes some or all of the problems associated with past solutions for preventing a door from relocking and/or propping a door open in an emergency situation.

SUMMARY OF THE INVENTION

In accordance with one aspect of the invention a system and device are provided that can be used in emergency (as well as other) situations to prop a door open and/or prevent the door from locking.

In accordance with one embodiment, the device of the present invention is formed as a generally rectangular, flat plate or bar with a first cut-out portion mid-way along one side, and a second cut-out portion mid-way along the opposing side. The device also includes a first and preferably a second or third magnet positioned on at least one face of the bar (in alternative embodiments additional magnets can be placed on the opposing face of the plate, or the originally magnets can extend through to be used on either side). Additional magnets can be provided and advantageously positioned on either face of the bar as needed for a particular use.

In use, the device can be used to prop a door open by inserting it in the hinge area of a held open door so that the door frame and the door are lodged into the cut-away portions of the plate. In this regard the plate can be inserted with the faces vertical and then twisted horizontally when in position. One of the magnets can be aligned with a hinge of the door to keep the plate from moving.

The device can also be used to prevent a door with an automatic locking mechanism from relocking once it has been opened. To prevent the door from relocking, the device can be positioned over the strike plate in the door frame. The magnets will keep the device in position over the strike plate and prevent the bolt from the door handle/locking system from extending when the door is shut. Because the bolt hits the device and is forced into and remains in a retracted position, the door will not relock when closed. Once the device is in place, the door can be opened and closed by without requiring each user to have a key.

By preventing the door from locking by placing the device over the strike plate, the door can be closed close to 98-99% of the way (and remain unlocked) if desired. Accordingly, if the door is an exterior door, it can be closed after the bar is secured on the strike plate to prevent inclement weather from entering the building or air-conditioning from escaping.

The device preferably includes indicia or other graphical indication of pertinent information that may be useful in an emergency situation on the outer surface (i.e., the visible surface when the device is positioned over the strike plate). For example, the device can warn others from removing it and that it should only be removed by authorized personnel. Paint or a label with an adhesive backing can be applied to the outer surface to provide the indicia. Additionally, the paint or label can include fluorescent or glow-in-the dark materials to provide additional visibility.

The present invention can be handmade. Alternatively, the present invention can be mass produced and manufactured by a machine in a conventional manner.

While the device was designed form use by EMS, Firemen and Police officers, it can be used in multiple other trades or for personal use. The device is designed to hold open or "chock" (a term used in the fire service) a door In accordance with one embodiment of the invention, a device for preventing a door with an automatic locking mechanism from relocking is disclosed. The device comprises a generally rectangular flat bar having a first surface and an opposing second surface. A first magnet is connected to the first surface of the bar and a layer of foam is connected to the first surface of the bar. The first magnet is configured to secure the bar over a bolt receiving opening of a strike plate set in a door frame to prevent a lock bolt positioned on the door from extending into the opening of the strike plate and locking the door.

The device can also include a second magnet and a third magnet connected to the first surface. All of the magnets, as well as the foam can be glued to the first surface.

Additionally, the device can formed from a generally rectangular piece of steel and include a first cut-away portion midway along a first side of the bar, and a second cut-away portion mid-way along a second side of the bar. Alternatively, the device can be formed from plastic or other suitable materials. The bar can include an indentation for receiving the first magnet or other magnets.

The device can also include a label on the second surface of the bar. The label can be fluorescent or contain a glow-in-the dark substance.

In accordance with another embodiment, a device for adhering to a door jamb to cover the opening of a strike plate and preventing a door with an automatic locking mechanism from extending a bolt into the opening of the strike plate and locking the door is provided. The device comprises a flat steel bar having a first side, an opposing second side, a first end and an opposing second end, a first surface extending between the first side, second side, first end and second end, and an opposing second surface extending between the first side, second side, first end and second end. A first magnet is positioned at a first location on the first surface of the steel bar; and a second magnet is positioned at a second location on the first surface of the steel bar different than the first position. The first and second magnets are positioned to enable securing of the steel bar to cover the opening of the strike plate. A third magnet can be positioned at a third location on the first surface of the steel bar different than the first surface and the second surface. A layer of foam having cut-out portions for the magnets can be connected to the first surface of the steel bar. The magnets and the foam can be glued to the bar.

The device can include a first cut-away portion mid-way along the first side of the steel bar, and a second cut-away portion mid-way along the second side of the steel bar. The first and second cut-away portions are configured to enable the device to be inserted between the door and a side of a door frame connected to the door by a hinge to prevent the door from closing.

In accordance with another embodiment of the invention, a method for preventing a door with an automatic locking mechanism from locking is provided. The method comprises providing a flat generally rectangular bar having a first surface and an opposing second surface, and a first magnet connected to the first surface, placing the bar over an opening of a strike plate in a door jamb and magnetically securing the first surface of the bar to the strike plate to prevent a bolt on the door from extending into the opening and locking the door.

The method can further comprise applying a glow-in-the dark label to the second surface of the bar to enhance visibility of the bar in an emergency situation. Additionally, the method can comprise providing a second magnet or a third magnet connected to the first surface of the bar spaced from the first magnet.

In accordance with yet another embodiment of the invention, a system for preventing a door from locking is provided. The system comprises a door hingedly connected to a door frame, the door including a locking mechanism having an extendable and retractable bolt. A metal strike plate is mounted in the door frame, the strike plate having an opening for receiving the bolt in an extended position. The system also includes a generally flat thin bar having a first side and a second side, the bar further including a first magnet connected to the first surface of the bar; the bar is magnetically connected to the strike plate by the first magnet and positioned to cover the opening in the strike plate to prevent the bolt from extending into the opening and activating the lock.

Other features and advantages of the invention will be apparent from the following specification taken in conjunction with the following Figures and Attachments.

BRIEF DESCRIPTION OF THE FIGURES AND ATTACHMENTS

To understand the present invention, it will now be described by way of example, with reference to the accompanying Figure and Attachment in which.

DETAILED DESCRIPTION OF A PREFERRED EMBODIMENT

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
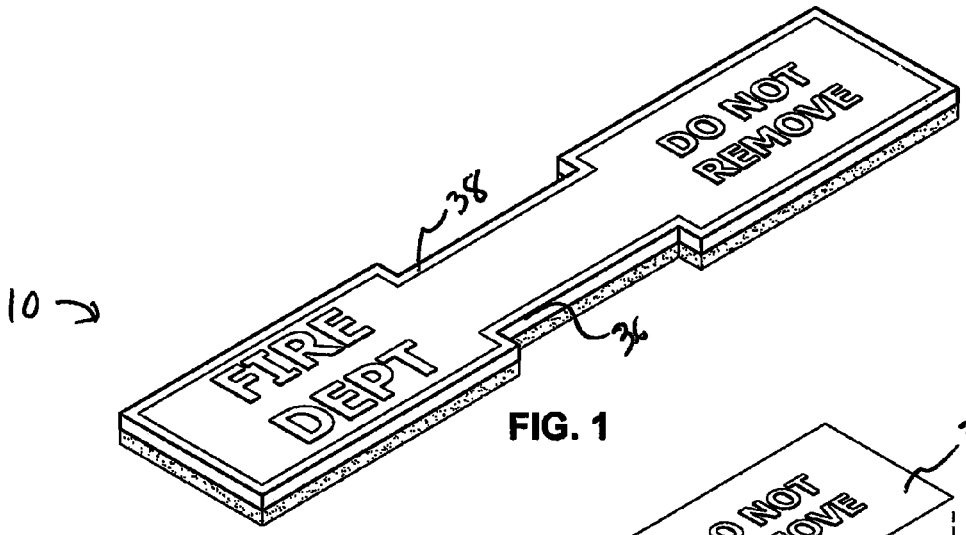
FIG. 1 is a perspective view of a device for preventing a door from locking or maintaining a door in an open position in accordance with an embodiment of the present invention.
Figure 2A:
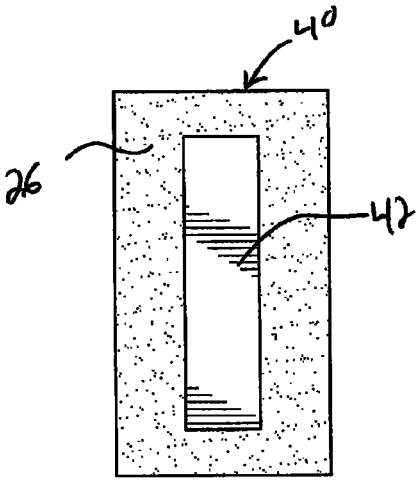
FIG. 2A is a plan view of the back of the device of FIG. 1B showing a magnet in accordance with one embodiment.
Figure 2B:
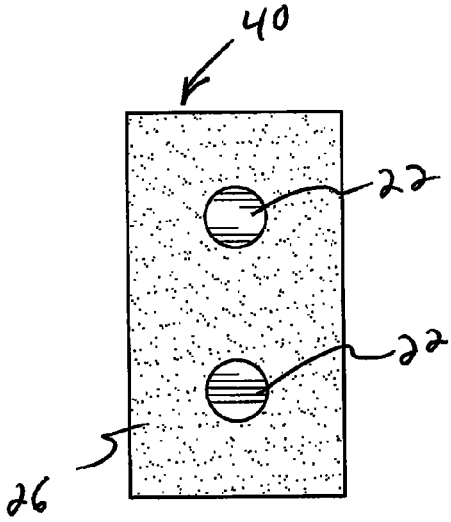
FIG. 2B is a plan view of the back of the device of FIG. 1B showing two magnets in accordance with a second embodiment.
Figure 2:
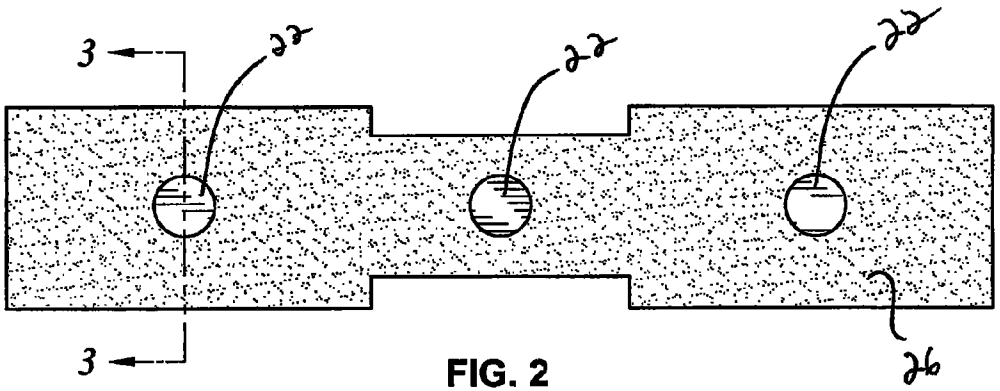
FIG. 2 is a plan view of the back of the device of FIG. 1.
Figure 3:
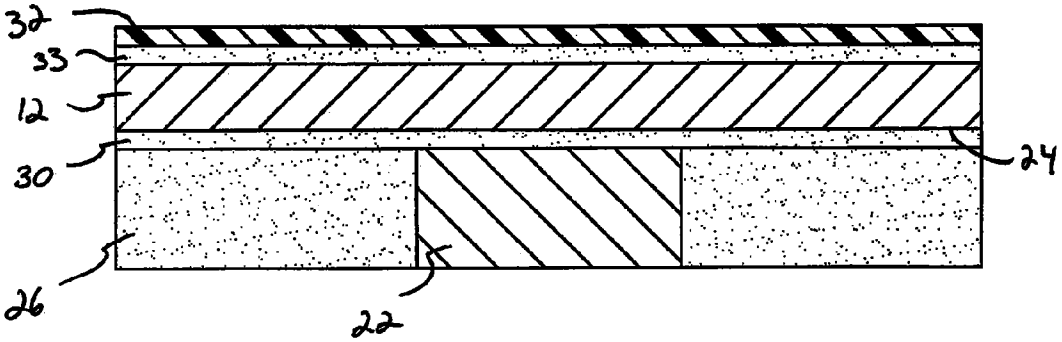
FIG. 3 is a cross-sectional view of the device of FIG. 2 taken along the line 3-3.

Referring to FIGS. 1, 2 and 3, a first embodiment of a device 10 in accordance with the present invention is shown. The device 10 includes a generally flat bar 12 having a first side 14, a second side 16, a first end 18 and a second end 20.

Three magnets 22 are connected to a first surface 24 of the bar 12. The magnets 22 have a generally cylindrical shape and are spaced apart along the first surface 24. However, other sizes, shapes and spacing of the magnets can be used as desired for a particular use or type of door or lock. Moreover, fewer or more magnets can be used as desired.

As discussed in more detail below, the magnets 22 are utilized to secure the device to the strike plate of a lock system to prevent the door from relocking. Additionally, one or more of the magnets can be used to connect the device to a hinge connecting the door to the frame when the device is used to prop the door in an open position.

Figure 1A:
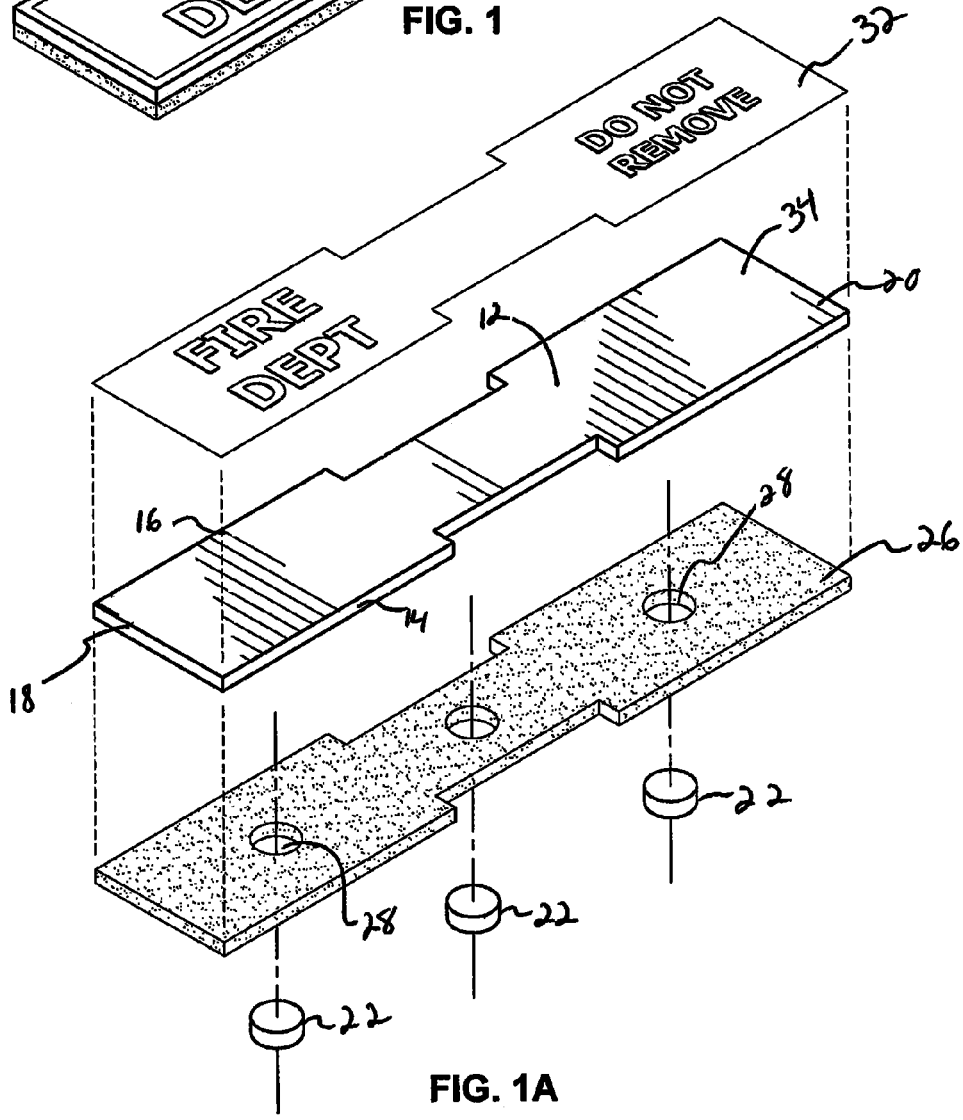
FIG. 1A is an exploded view of the device of FIG. 1.

In addition to the magnets 22, a layer of foam material 26 is connected to the first surface 24 of the bar 12. As shown in FIG. 1A, the foam 26 includes cutouts 28 that match the size and shape of the magnets 22. Both the foam and the magnets are glued to the first surface 24 via a layer of glue 30.

A label 32 is applied by an adhesive or glue layer 33 to a second surface 34 of the bar 12. The label 32 can include indicia or other graphical indication of pertinent information that may be useful in an emergency situation. For example, in the embodiment shown in FIG. 1, the label 32 identifies the device as being from the Fire Department, and instructs others "Do Not Remove." The label 32 can be made from a fluorescent or glow-in-the dark material or may be reflective in order to be more easily seen.

The indicia can be used to alert the public or other emergency workers to know the door is being maintained open by emergency personnel. As backup arrives and enters the building, the device acts as a notification that other crews may already be working in the area.

Instead of a separate label being attached to the bar by an adhesive, the label could be painted, or printed directly on the second surface 34 of the bar 12. When the device is secured to the strike plate, the second surface 34 is preferably visible and may sometimes be referred to as the outer surface. The first surface 24 preferably contacts the strike plate (because of the proximity of the magnets 22) and may be referred to as the inner surface.

The device 10 of FIG. 1 has a generally rectangular shape with the exception of a first indentation or cut-away portion 36 midway along the first side 14, and a second indentation or cut-away portion 38 midway along the second side 16. The cut-away portions 36, 38 assist in using the device 10 to prop the door in an open position.

Figure 1B:
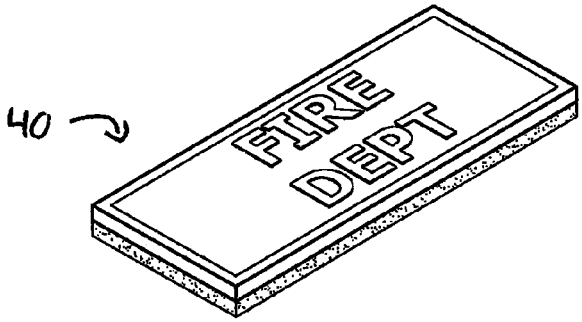
FIG. 1B is a perspective view of a device for preventing a door from locking in accordance with another embodiment of the present invention.

An alternative embodiment of a device 40 in accordance with aspects of the present invention is shown in FIG. 1B. In this embodiment, the device 40 does not include the cut-away portions, and is generally smaller than the device 10 of FIG. 1. FIG. 2A shows the device 40 with a single magnet 42 extending along the mid portion of the first surface. FIG. 2B shows an alternative embodiment with two cylindrical magnets 22 similar to the ones shown with the device 10 of FIG. 1.

Preferably, the bar 12 of the embodiment of the device 10 of FIG. 1 is a 6"×1½"×⅛" A36 steel flat bar, and the bar of the embodiment of the device 40 in FIG. 1B is a 4"×1½"×⅛" A36 steel flat bar. A super glue (e.g., Gorilla Glue) or spray adhesive can be used to glue the foam and magnets to the bars. In some cases, the foam can be obtained from a supplier with an adhesive already applied to one side.

The cylindrical magnets 22 are preferably ½" round craft power magnet. Other shapes, such as (for example) rectangle, square or a larger size can also be used. The foam 26 is preferably a Black 3 mm EVA (Ethylene-vinyl acetate) craft foam, or similar type of foam. The foam is cut to size to fit on the first surface.

The label 32 is preferably a vinyl sticker with fluorescent coloring. Alternatively, a white (or other color) enamel spray paint can be used.

In addition to the preferred materials, the bar can be made from a hard plastic or other suitable material, and may be used with or without the foam. Moreover, in any embodiment, the bar can include indentations on the first surface for receiving the magnets. This allows for more securely connecting the magnets to the bar. Additionally, magnets of the same size (as the ones shown in FIG. 1A) will not extend as far from the bar depending on the/depth of the indentation. Alternatively, providing the indentation could allow for use of larger magnets without having them extend further from the first surface. In one embodiment, the outermost surface of the magnets can lay flush, or possibly below, the first surface. Some devices could completely encase the magnets (this could be easily accomplished with plastic bars).

In many older buildings, certain doors, such as those to the stairwells include locks that automatically lock the door when it is shut behind one entering the stairwell. This can create problems in an emergency situation, such as a fire in the building, where access through the door may be necessary.

Figure 7A:
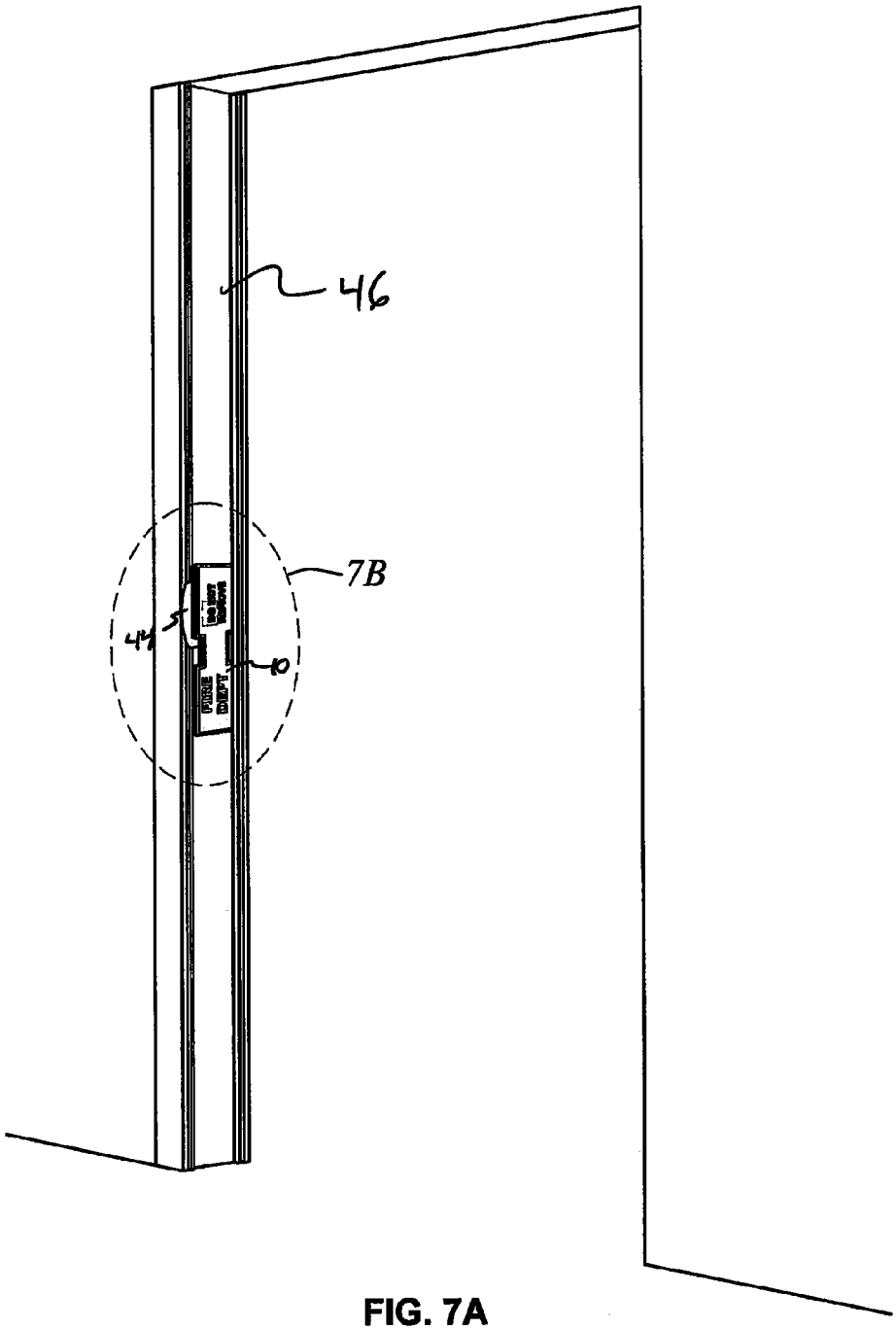
FIG. 7A is a perspective view of the device of FIG. 1 positioned over a strike plate of a lock in the door jamb.
Figure 7B:
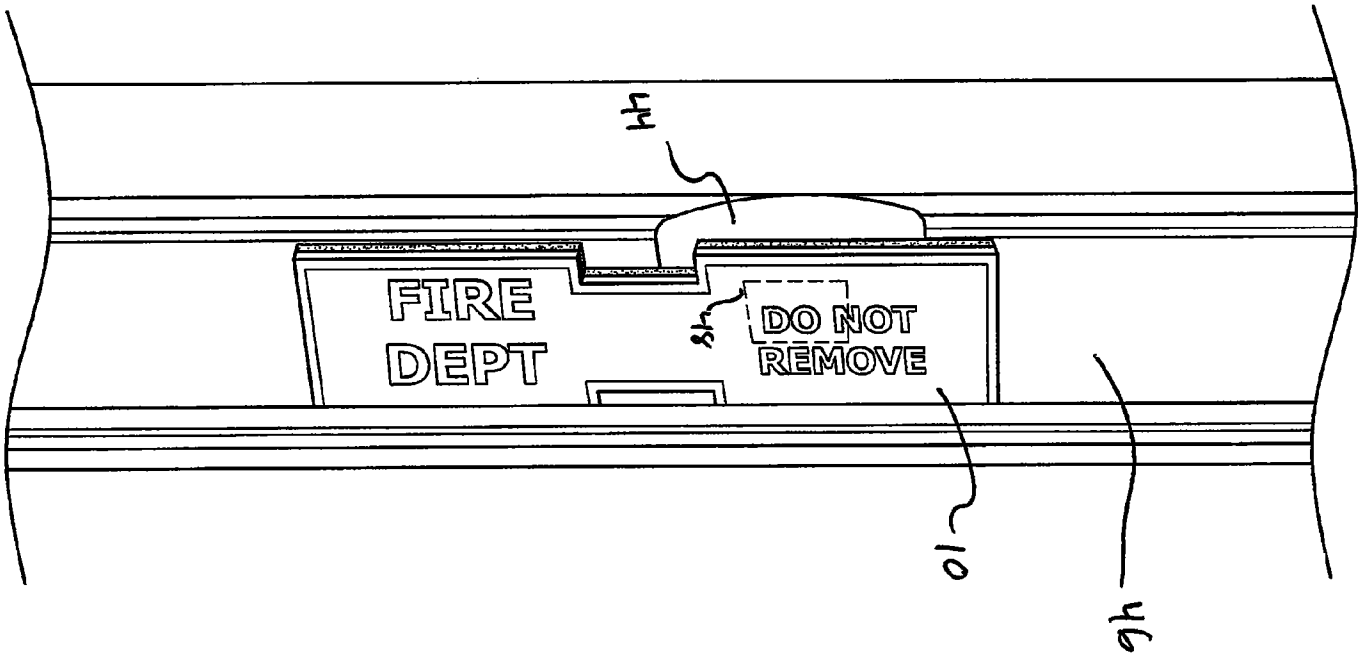
FIG. 7B is an enlarged view of the device as shown in FIG. 7A.

The device 10 (as well as device 40) is primarily used to prevent such automatically locking doors from relocking once opened. Referring to FIGS. 7A and 7B, the device 10 is placed over the strike plate 44 positioned in a door frame 46. In particular, the device 10 is secured over an opening 48 (shown in phantom) in the strike plate 44 that is used to receive a bolt member located on a door. One or more of the magnets 22 will secure the device 10 to the metal of the strike plate 44. In some instances, the door frame 46 may be made from metal, and the magnets 22 may attach to the frame 46.

Figure 8A:
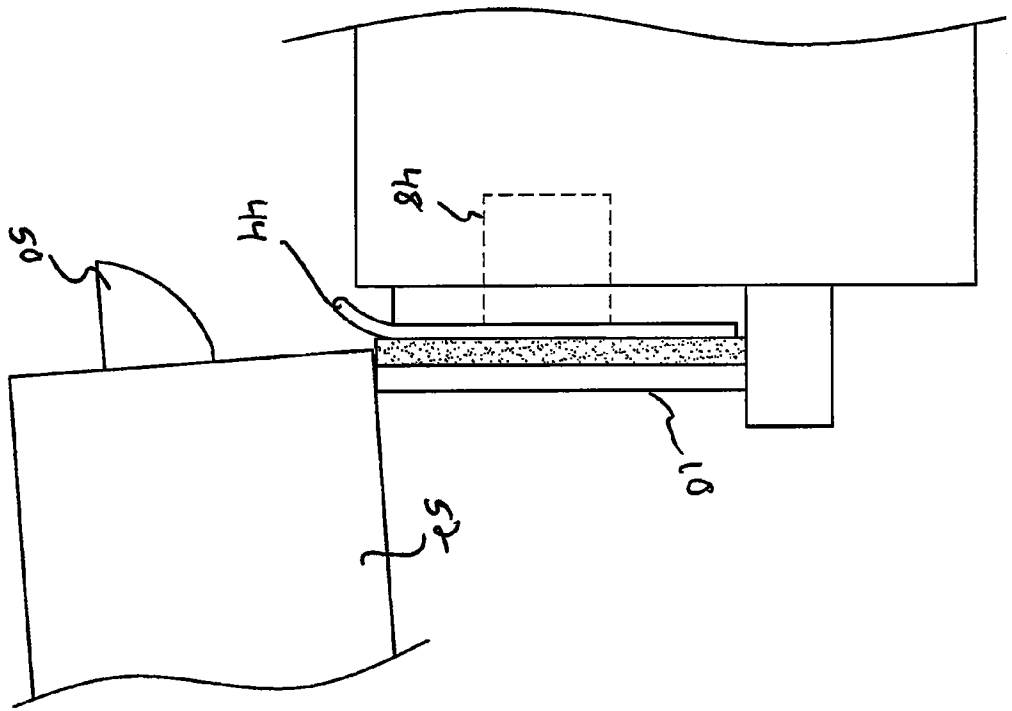
FIG. 8A is a cross-sectional view showing the device preventing a door having a tight fit in the door frame from locking; and, FIG. 8B is a cross-sectional view showing the device preventing the bolt from the door locking mechanism from extending into the opening of the strike plate.
Figure 8B:
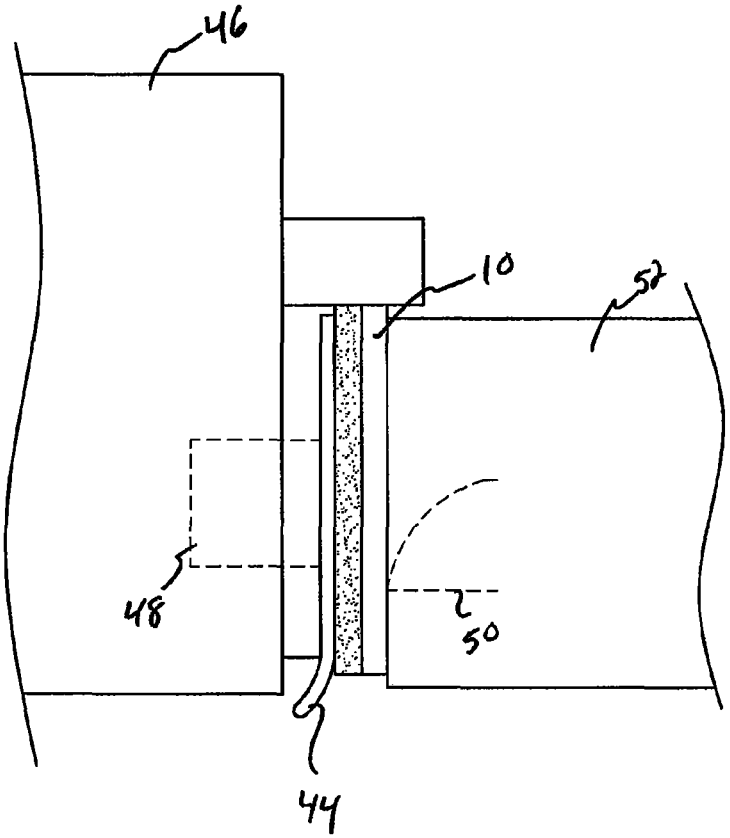

Referring to FIG. 8B, the device 10 will prevent the bolt member 50 (shown in phantom) in a door 52 from extending into the opening 48 of the strike plate 44 and locking the door. Instead, the bolt member 50 remains in a retracted state within the lock mechanism. The door can thus be pushed open.

In some cases, depending on the dimensional tolerances of the door 52 or door frame 46, as well as the thickness of the device 10, the device 10 may connect with the edge of the door 52 and prevent it from completely closing as shown in FIG. 8A. In this instance the bolt member 50 will still be in an extended position, but the door will not be locked in the frame 46 and can be pushed open.

Figure 4:
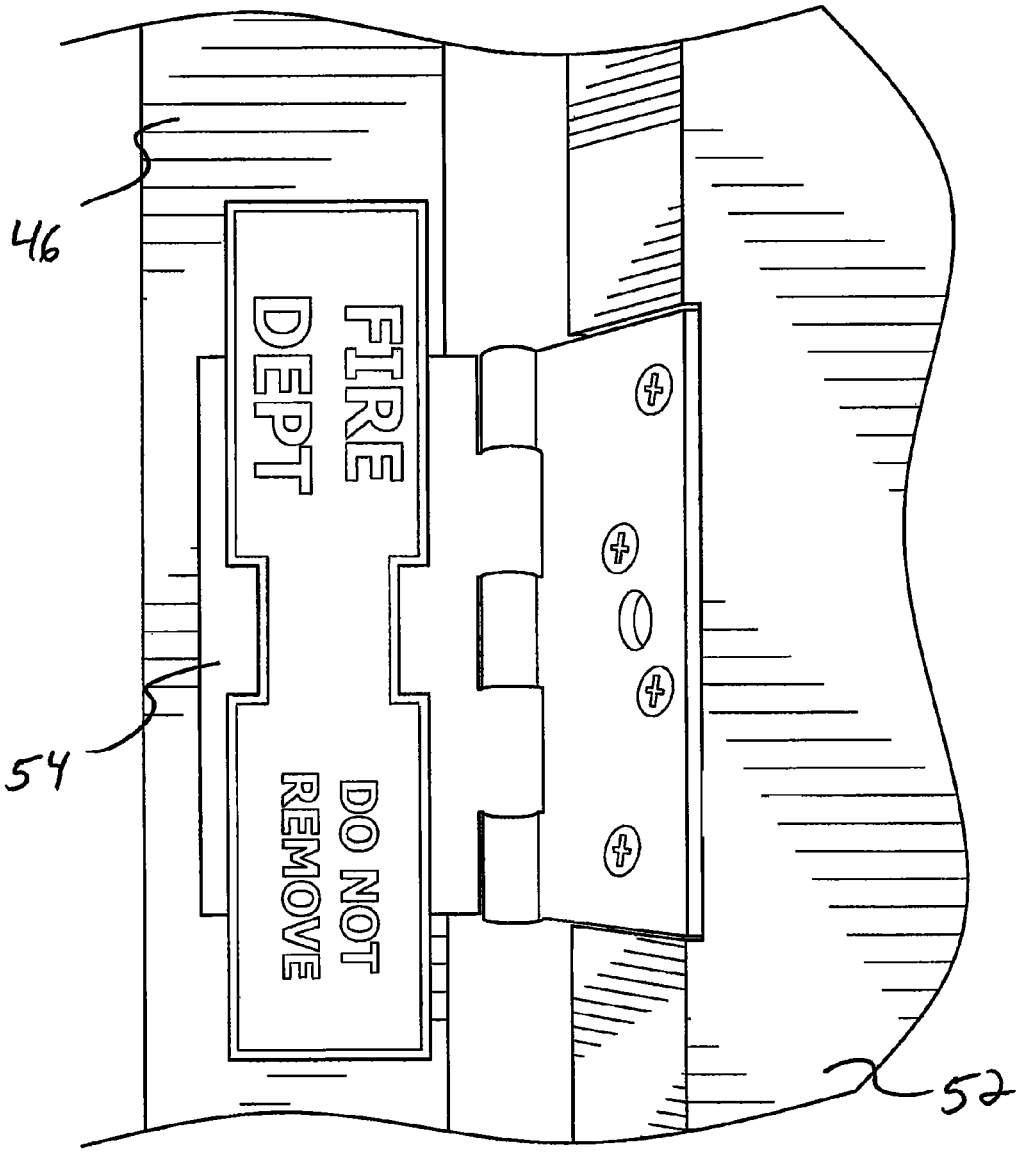
FIG. 4 is a perspective view of the device of FIG. 1 positioned on a hinge plate connected to a door jamb.

The device 10 can be used at other locations about the door 52 to prop it open. Referring to FIG. 4, the device 10 can be placed on one of the plates of a hinge 54 connecting the door 52 to the door frame 46. Again, the magnets 22 secure the device 10 to the metal in the hinge 54. Although shown connected to the hinge plate on the door frame 46, the device could alternatively be positioned on the hinge plate connected to the door 52. In either case, the device 10 prevents the hinge from completely closing, and thus keeps the door 52 from completely closing and relocking.

On occasion, a door that may not normally work with the device 10, may have been repaired or modified to include metal screws or a metal jamb. In these instances, the device 10 can be attached to the screws or jamb to prevent the door from closing.

In another alternative use, the device 10 can be utilized to prop (or chock) the door 52 in an open position. In the example shown in FIG. 5, the device 10 is inserted between the door 52 and the top of the door frame 46. In this example, an edge of the door 52 and an edge of the door frame 46 contacts the device 10 in a respective cut-away portion 36, 38.

Figure 5:
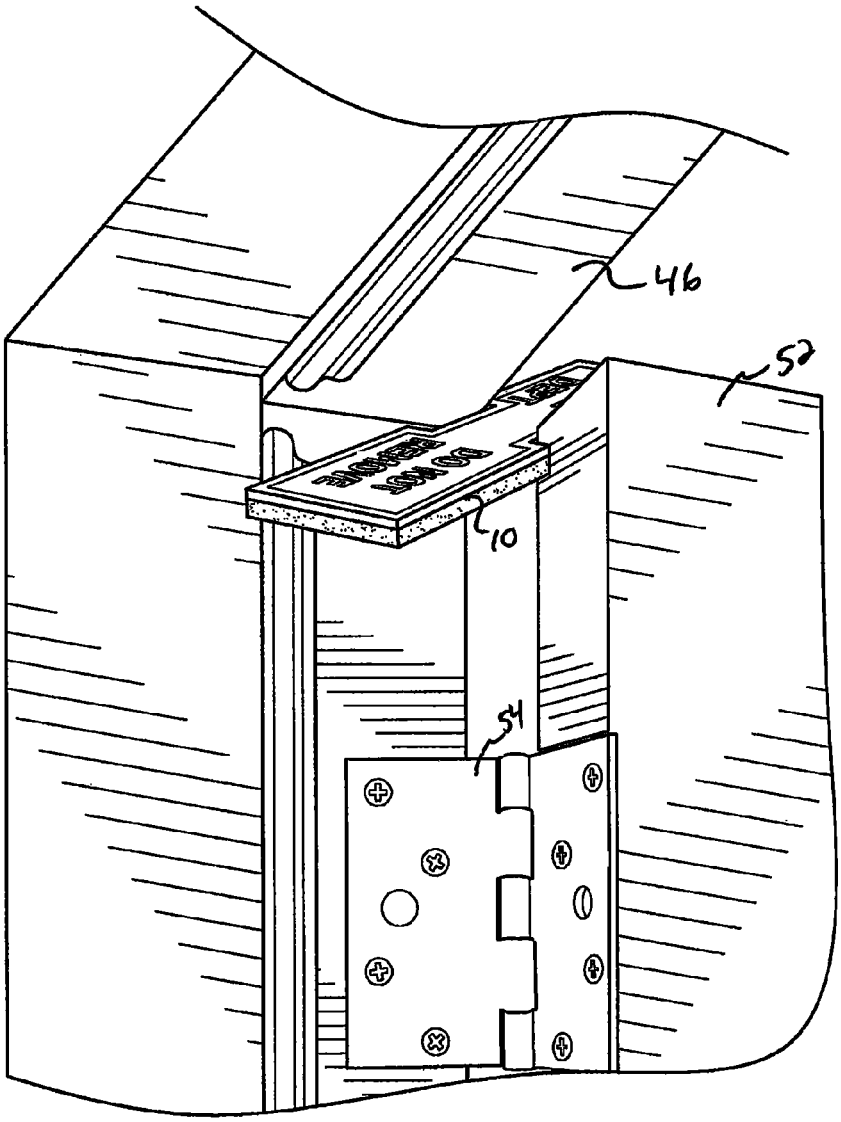
FIG. 5 is a perspective view of the device of FIG. 1 lodged in an upper corner of a doorframe between the frame and the door.
Figure 6:
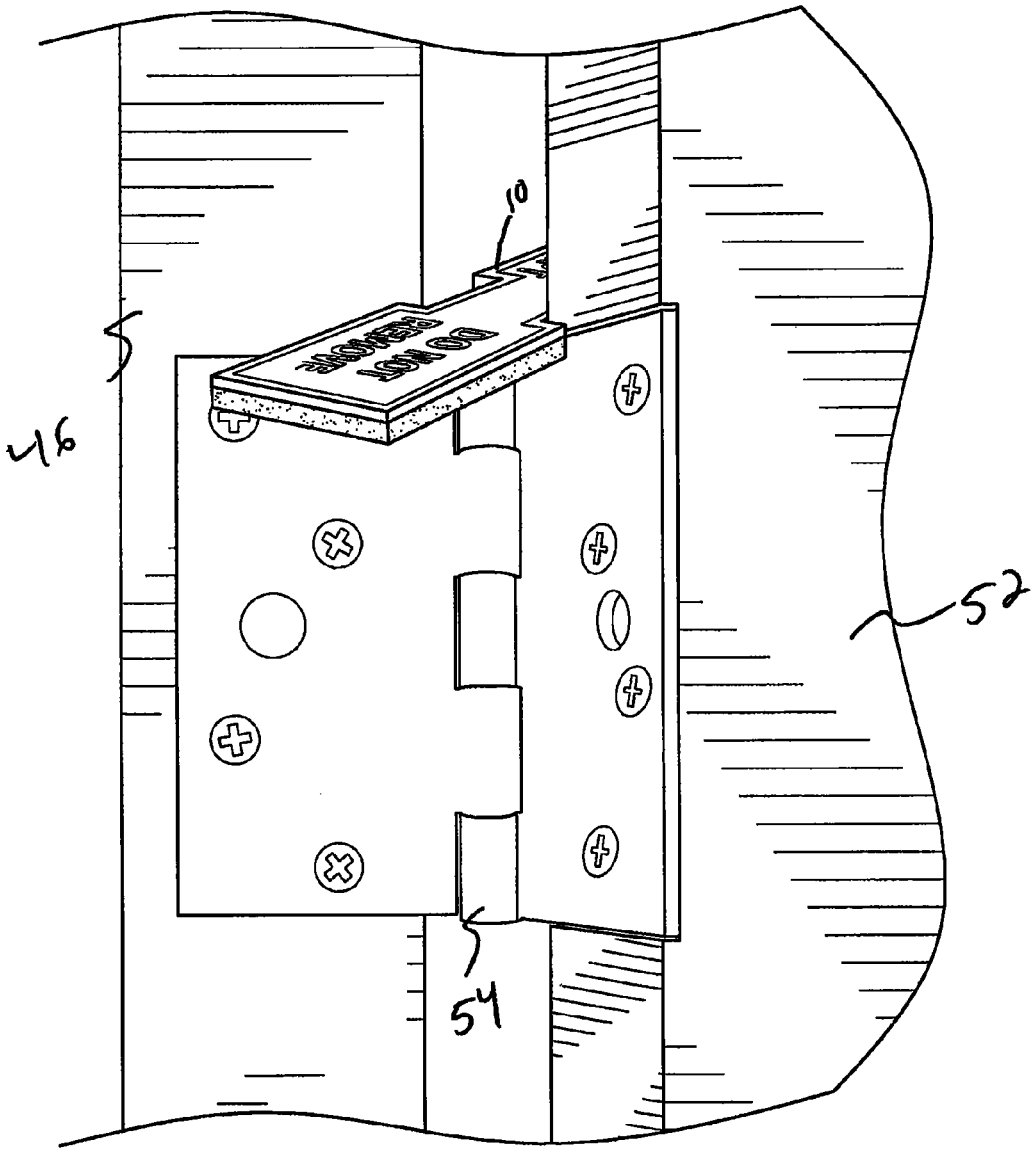
FIG. 6 is a perspective view of the device of FIG. 1 lodged between a door and the doorframe proximate a hinge.

Similar to the use shown in FIG. 5, the device 10 can be inserted between an edge of the door 52 and an edge of the door frame 46 proximate one of the hinges 54 as shown in FIG. 6. In this instance, one of the magnets 22 will secure the device 10 to the metal of the hinge which will help keep it in place. In both cases (FIG. 5 and FIG. 6), the door is propped in an open position rather than merely prevented from locking.

Firemen, or other emergency personnel, can carry a stack of the devices 10 into a building in an emergency situation. As the firemen move upward through the building, a new device 10 can be used at each door by quickly slapping one against the strike plate 44 in the door frame 46. After the situation has been resolved, the devices 10 can be quickly and easily removed.

Other modifications come to mind that can be employed in the device. These include adding a battery (or substituting one of the magnets 22 for a battery) and using it to power light emitting diodes (LEDs) positioned on or embedded in the device. The LEDs could be static or flashing, and may spell out or graphically display a warning or other message. Alternatively, or in addition, the battery could be used to power a radio signal beacon—that may be turned on by someone who becomes trapped or cannot find their way out of the building (possibly from lack of visibility due to smoke)—to alert the Emergency personnel of some problem at that location. In these embodiments, the device could be placed on any metal surface where it may be visible and of use in the emergency situation (and not just in connection with opening a door or preventing it from locking).

Additionally, the label can be modified to provide instructions for using the features discussed above. The label can also be modified to identify a number on the device (to enable the Emergency personnel to keep track of how many were used and need to be collected after the emergency situation), and other information, such as an identification of the crew or fire/police department that used the device (to enable collected devices to be returned to the proper entity).

While the specific embodiments have been illustrated and described, numerous modifications come to mind without significantly departing from the spirit of the invention and the scope of protection is only limited by the scope of the accompanying Claims.

I claim:

1. A device for preventing a door with an automatic looking mechanism from relockmg the device comprising:

a generally rectangular flat bar having a first side, a second side, a first surface between first side and second side and an opposing second surface between the first side and second side;

a first magnet connected to the first surface of the bar;

a layer of foam connected to the first surface of the bar, the layer of foam having a first cutout about the first magnet wherein the first magnet is configured to secure the bar over a bolt receiving opening of a strike plate set in a door frame to prevent a lock bolt positioned on the door from extending into the opening of the strike plate and locking the door; and, a first cut-away portion mid-way along a first side of the bar, and a second cut-away portion mid-way along a second side of the bar, the first cut-away portion and the second cut-away portion adapted to contact a door frame and an edge of a door to prop the door in an open position.

2. The device of claim 1 further comprising a second magnet connected to the first surface of the bar spaced from the first magnet.

3. The device of claim 2 further comprising a third magnet connected to the first surface of the bar, the third magnet spaced from both the first magnet and the second magnet.

4. The device of claim 1 further comprising a label on the second surface of the bar.

5. The device of claim 4 wherein the label comprises a glow-in-the dark substance.

6. The device of claim 1 wherein the bar is formed from a generally rectangular piece of steel.

7. The device of claim 1 wherein the bar is formed from plastic.

8. The device of claim 1 wherein the bar includes an indentation for receiving the first magnet.

9. The device of claim 1 wherein the first magnet is connected to the first surface of the bar by glue.

10. A device for securing to a door jamb to cover an opening of a strike plate and preventing a door with an automatic locking mechanism from extending a bolt into the opening of The strike plate and locking the door, the device comprising:

a flat steel bar having a first side, an opposing second side, a first end and an opposing second end, a first surface extending between the first side, second side, first end and second end, and an opposing second surface extending between the first side, second side, first end and second end;

a first magnet positioned at a first location on the first surface of the steel bar; and a second magnet positioned at a second location on the first surface of the steel bar different than the first position, the first and second magnets positioned to enable security of the steel bar to cover the opening of the strike plate; and, a first cut-away portion midway along the first side of the steel bar, and a second cut-away portion mid-way along the second side of the steel bar, the first and second cut-away portions configured to enable the device to be inserted between the door and a side of a door frame connected to the door by a hinge to prop the door in an open position.

11. The device of claim 10 farther comprising a third magnet positioned at a third location on the first surface of the steel bar different than the first surface and the second surface.

12. The device of claim 11 further comprising a layer of foam connected to the first surface of the steel bar.

13. The device of claim 10 wherein the first magnet and second magnet are glued to the first surface of the steel bar.

14. The device of claim 12 wherein the layer of foam includes a first cutout about the first Magnet and a second cutout about the second magnet to expose an outer surface of the first magnet and an outer surface of the second magnet.

* * * * *

UNITED STATES PATENT AND TRADEMARK OFFICE

CERTIFICATE OF CORRECTION

PATENT NO. : 8,727,404 B2
APPLICATION NO. : 12/918002
DATED : May 20, 2014
INVENTOR(S) : Martin It is certified that error appears in the above-identified patent and that said Letters Patent is hereby corrected as shown below:

In the Specification:

Column 1, line 13, in "Cross-Reference to Related Applications," delete "789filed" and insert --789 filed-- therefor;

In the Claims:

Column 7, line 54, in Claim 1, delete "looking" and insert --locking-- therefor;

Column 7, line 55, in Claim 1, delete "relockmg" and insert --relocking-- therefor;

Column 8, line 32, in Claim 10, delete "The" and insert --the-- therefor;

Column 8, line 40, in Claim 10, delete "and" and insert --and,-- therefor;

Column 8, lines 43-44, in Claim 10, delete "security" and insert --securing-- therefor;

Column 8, line 53, in Claim 11, delete "farther" and insert --further-- therefor;

Column 8, line 56, in Claim 12, delete "claim 11" and insert --claim 10-- therefor;

Column 8, line 61, in Claim 14, delete "Magnet" and insert --magnet-- therefor.

Signed and Sealed this
Nineteenth Day of August, 2014

Michelle K. Lee

Michelle K. Lee
*Deputy Director of the United States Patent and Trademark Office*